United States Patent [19]

Borgis et al.

[11] Patent Number: 4,717,600

[45] Date of Patent: Jan. 5, 1988

[54] PROCESS FOR IMPROVING THE TOUCH AND DRAPING CHARACTERISTICS OF TEXTILE PRODUCTS BASED ON POLYESTER

[75] Inventors: Roberto Borgis, Verbania Intra; Giorgio Honorati, Milan, both of Italy

[73] Assignee: Montefibre S.p.A., Milan, Italy

[21] Appl. No.: 872,024

[22] Filed: Jun. 9, 1986

[30] Foreign Application Priority Data

Nov. 23, 1984 [IT] Italy ..... 44823 A/84

[51] Int. Cl.[4] ..... B05D 3/02

[52] U.S. Cl. ..... 427/393.1; 427/389.9; 427/393.2

[58] Field of Search ..... 427/393.2, 394, 393.1, 427/389.9, 384

[56] References Cited

U.S. PATENT DOCUMENTS

| | | | |
|---|---|---|---|
| 2,137,465 | 11/1938 | Thackston | 427/393.2 X |
| 2,421,363 | 5/1947 | Young | 427/393.1 |
| 3,054,699 | 9/1962 | Moyse | 427/393.2 X |
| 3,703,351 | 11/1972 | Lock | 427/393.2 X |
| 4,413,998 | 11/1983 | Guth et al. | 427/393.2 X |

*Primary Examiner*—Thurman K. Page

*Attorney, Agent, or Firm*—Stevens, Davis, Miller & Mosher

[57] ABSTRACT

A process for improving the touch and draping characteristics of polyester-based textile products by controlled and discontinuous treatment with an aqueous solution of a hydroxide of an alkaline metal containing a hydrolysis accelerator, in which the hydroxide amount of alkaline metal contained in the aqueous medium is adjusted as a function of the textile product weight loss to be obtained in the ratio 1:2.4 and in which the ratio: textile product weight/aqueous solution volume ranges from 1:5 to 1:100.

4 Claims, No Drawings

PROCESS FOR IMPROVING THE TOUCH AND DRAPING CHARACTERISTICS OF TEXTILE PRODUCTS BASED ON POLYESTER

This invention relates to a process for improving the touch and draping characteristics of textile products based on polyester.

The term "textile products based on polyester" as is used herein and in the appended claims, means threads, filaments, staple fibers, yarns, multifilament threads, either texturized or plain, and textiles, including non-woven fabrics, knitted yarns, non-laddering fabrics, fabrics for curtains etc., consisting of polyester or containing at least 50% of polyester and less than 50% of other natural, man-made or synthetic products.

The term "polyester", as is used in the present specification and in the appended claims, means the polymers containing, in their recurring unit, the terephthalic group and which are capable of forming fibers.

Such polyesters are preparable by polycondensation of a glycol having the general formula:

$$HO-(CH_2)_n-OH,$$

wherein n is an integer from 2 to 10, with an aromatic bicarboxylic acid of formula:

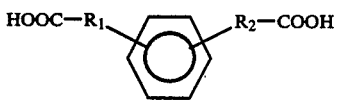

in which $R_1$ and $R_2$ represent the radical $-(CH_2)_m-$ in which m is zero or an integer from 1 to 4.

Lesser amounts of other copolymerizable divalent compounds can be incorporated in amounts up to 15% by weight.

As is known, in order to improve the touch and draping characteristics of the textiles or textile products based on polyester it has been suggested, in British Pat. No. 652,948, to subject such textiles to a hot treatment with an aqueous solution of a hydroxide of an alkaline metal, in particular caustic soda or potash.

Such treatment causes a weight loss of the fabric due to the dissolution of the polyester by hydrolysis from the filament surface, and such loss can be determined by weighing the dry textile before and after the treatment with the alkaline solution.

The treatment of a textile based on polyester fibers with an alkaline solution in order to achieve the purpose mentioned hereinabove, however, is affected in practice by several difficulties, particularly when the process is carried out on a commercial scale.

In fact, in order to obtain an appreciable weight loss of the fabric and so a sensible improvement of the touch and draping characteristics, it is necessary to operate with high concentration solutions and/or for very long times and/or at high temperatures. Under these conditions it is very difficult to control the hydrolysis process during the operative step, so that the effect of the treatment with an alkaline hydroxide does not provide reproduceable results.

With a view to overcoming the above-mentioned drawbacks it has been suggested to add to the alkaline solution various substances acting as hydrolysis accelerators.

Suitable substances acting as hydrolysis accelerators may be a quaternary ammonium salt selected from cetyl-trimethylammonium bromide and lauryl-dimethyl-benzyl-ammonium chloride, or an ammonium sulphate selected from tri-methyl-stearyl-ammonium-methylsulphate and di-methyl-ethyl-coco-ammonium-ethyl-sulphate.

The treatment with the alkaline solution containing one of the accelerators cited hereinabove can be carried out either discontinuously, for example in jigger, jet, overflow or in a reel vat, or continuously, for example by padding and heat treatment with an air-vapor mixture.

However, even if it is operated with a solution of an alkaline metal hydroxide in the presence of a hydrolysis accelerator, no satisfactory results are obtained, as the process does not yet give sufficient guarantees of being reproduceable.

It is an object of the present invention to provide a process free from the drawbacks cited hereinbefore.

More particularly, the object of the present invention is to provide a process for the discontinuous treatment of textile products based on polyester which permits to obtain both uniformity and reproceability of the treatment.

We have now found, and that is the object of this invention, that this and still other objects are achieved by a process for the discontinuous hot treatment of polyester-based textile products with an aqueous solution of an alkaline metal containing a hydrolysis accelerator, in which the amount of the alkaline metal hydroxide contained in the solution is adjusted as a function of the textile product weight loss to be obtained according to the weight ratio 1:2.4 and in which the ratio: textile produce weight/aqueous solution volume ranges from 1:5 to 1:100.

The amount of hydrolysis accelerator is not critical in the process of the present invention, although higher amounts than 0.5 g/l of solution are preferred. Such amounts vary as a function of temperature and of treatment time and can range from 1 to 10 g/l, for a temperature range of from 140° to 60° and for a time ranging from 30 to 240 minutes.

The process of the present invention can be conducted in any discontinuously operating device, such as in jigger, jet, over-flow, reel vat etc.

In order to optimize the mechanical characteristics of the textile articles obtained by the process of the present invention it is preferable, in most cases, to subject the textile product, prior to treatment with the solution of a metal alkaline hydroxide, to a scouring and heat-setting operation.

Heat-setting is conducted in dry hot air at a temperature of from 160° to 220° C.

The characteristics of the textile product obtained can be optimized also by subjecting such product to washing with an alkaline solution, subsequent to a treatment with the solution of a hydroxide of an alkaline metal and prior to an optional neutralization treatment.

The process forming the object of the present invention permits to obtain prefixed results, which are perfectly reproduceable and independent from count and structure of the treated textile product.

The present invention is further explained by the following examples, which are given for a merely illustrative purpose and are not to be considered as a limitation thereof.

EXAMPLE 1

100 kg of a shuttle fabric weighing 100 g/m$^2$, consisting in warp and weft of polyethyleneterephthalate yarn having a count of 50/36 dtex, after scouring and heat setting at 190° C. in a Rameuse during 30 seconds, was immersed into a jet containing 2000 l of an aqueous solution containing 10 kg of hydrated sodium hydroxide and 4 kg of dimethyl-benzyl-lauryl-ammonium chloride, prepared at 50° C. The fabric was maintained in such solution at 110° C. for 60 minutes. Subsequently it was cooled, the solution was discharged and the fabric was repeatedly washed, neutralized with a dilute solution of acetic acid, and air-dried at 110° C. The fabric final weight was 76 kg, corresponding to a loss weight of 24%.

The touch and draping characteristics of the fabric so treated were fully like those of an equal silk fabric.

EXAMPLE 2

The same results as regards weight loss as well as touch and draping characteristics were obtained by treating, under the same conditions of example 1, shuttle fabrics made from polyethyleneterephthalate yarn having the following counts: 33/10 dtex, 33/24 dtex, 50/10 dtex, 50/48 dtex, 78/36 dtex, 110/48 dtex, 167/30 dtex and 167/72 dtex; or circular knitted fabrics or non-laddering fabrics producted starting from polyethyleneterephthalate yarns having the above-cited counts.

EXAMPLE 3

The same results as regards weight loss, and touch and draping characteristics of example 1 were obtained by varying, in the process of example 1, the treatment temperature from 60 minutes to 240 minutes or by varying the amount of accelerator from 2 g/l to 1 g/l or to 5 g/l.

What is claimed is:

1. A process for improving the touch and draping characteristics of textile products based on polyester by discontinuous hot treatment with an aqueous solution of a hydroxide of an alkaline metal containing a hydrolysis accelerator, characterized in that the amount of the alkaline metal hydroxide contained in the solution is adjusted as a function of the textile product weight loss to be obtained according to the weight ratio 1:2.4, that the ratio: textile product weight/aqueous solution volume ranges from 1:5 to 1:100, and that the hydrolysis accelerator is selected from the class consisting of cetyl-trimethyl-ammonium bromide, lauryl-dimethyl-benzyl-ammonium chloride, trimethyl-stearyl-ammonium methyl sulphate and dimethyl-ethyl-coco-ammonium-ethyl sulphate.

2. The process according to claim 1, in which the hydrolysis accelerator amount is higher than 0.5 g/l of solution.

3. The process according to claim 2, in which the hydrolysis accelerator amount ranges from 1 to 10 g/l.

4. The process according to claim 1, in which the treatment is conducted at a temperature ranging from 140° to 60° C. and during a time from 30 to 240 minutes.

* * * * *